US008991638B2

(12) United States Patent
Nelson et al.

(10) Patent No.: US 8,991,638 B2
(45) Date of Patent: Mar. 31, 2015

(54) WATER SEEPAGE ABATEMENT IN WATER HEATERS

(75) Inventors: Jonathan D Nelson, Louisville, KY (US); Eliel Fresco Rodriguez, Dayton, OH (US); Samuel Vincent Duplessis, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/571,850

(22) Filed: Aug. 10, 2012

(65) Prior Publication Data

US 2013/0043252 A1 Feb. 21, 2013

Related U.S. Application Data

(60) Provisional application No. 61/524,418, filed on Aug. 17, 2011.

(51) Int. Cl.

| | |
|---|---|
| ***B65D 88/00*** | (2006.01) |
| ***B65D 90/00*** | (2006.01) |
| ***F28D 15/00*** | (2006.01) |
| ***B21D 53/02*** | (2006.01) |
| ***F24H 9/02*** | (2006.01) |
| ***F24H 9/12*** | (2006.01) |
| *F24H 4/04* | (2006.01) |

(52) U.S. Cl.

CPC ..... *F28D 15/00* (2013.01); *B21D 53/02* (2013.01); *F24H 9/02* (2013.01); *F24H 9/124* (2013.01); *F24H 4/04* (2013.01)

USPC ..... 220/567.3

(58) Field of Classification Search

CPC ..... F24H 9/02; F24H 9/20; F24H 4/04; F25B 27/00; F25B 27/02; B23P 19/04; F24C 1/00

USPC ..... 220/567.3, 601, 610, 694.1; 122/19.2, 122/494; 126/344

See application file for complete search history.

(56) References Cited

U.S. PATENT DOCUMENTS

| | | | | | |
|---|---|---|---|---|---|
| 4,320,630 | A | * | 3/1982 | Uselton et al. | 62/238.6 |
| 4,477,399 | A | * | 10/1984 | Tilton | 264/45.2 |
| 4,865,014 | A | * | 9/1989 | Nelson | 122/19.2 |
| 5,152,843 | A | | 10/1992 | McDonald et al. | |
| 5,743,422 | A | * | 4/1998 | Hale | 220/4.33 |
| D440,287 | S | * | 4/2001 | Jackson et al. | D23/322 |
| 6,698,386 | B1 | * | 3/2004 | Hoffman | 122/14.31 |
| 6,748,646 | B2 | * | 6/2004 | Von Arx et al. | 29/613 |
| D501,918 | S | * | 2/2005 | Scott | D23/321 |

(Continued)

FOREIGN PATENT DOCUMENTS

JP 2011069503 A 9/2009

*Primary Examiner* — Anthony Stashick
*Assistant Examiner* — Jennifer N Zettl
(74) *Attorney, Agent, or Firm* — Global Patent Operation; Douglas D. Zhang

(57) ABSTRACT

A water heater system includes a water heater, a cover, a shroud and at least one ring. The water heater includes a tank, a layer of foam surrounding the tank and a wrapper surrounding the layer of foam. The cover is positioned on a top edge of the water heater. The shroud is positioned over the cover. The at least one ring is positioned around at least one of an inlet port and an outlet port of the water heater. The cover, shroud and at least one ring are operative to prevent a liquid from coming into contact with at least one of the layer of foam surrounding the tank and one or more components covered by the shroud.

11 Claims, 11 Drawing Sheets

(56) References Cited

U.S. PATENT DOCUMENTS

| | | | | | |
|---|---|---|---|---|---|
| D502,539 | S | * | 3/2005 | Ashbaugh et al. | D23/321 |
| 7,493,877 | B2 | * | 2/2009 | Broadway et al. | 122/19.2 |
| 7,516,721 | B2 | * | 4/2009 | Syler | 122/19.2 |
| D603,492 | S | * | 11/2009 | Lopez et al. | D23/318 |
| D605,263 | S | * | 12/2009 | Nelson et al. | D23/318 |
| D607,094 | S | * | 12/2009 | Tanbour | D23/322 |
| 7,650,859 | B2 | * | 1/2010 | Gordon et al. | 122/19.2 |
| 7,765,959 | B2 | * | 8/2010 | Syler | 122/19.2 |
| D638,528 | S | * | 5/2011 | Zhou et al. | D23/318 |
| D646,104 | S | * | 10/2011 | Zhou et al. | D7/305 |
| D646,367 | S | * | 10/2011 | Knorck et al. | D23/318 |
| D665,483 | S | * | 8/2012 | Fu et al. | D23/318 |
| 8,385,729 | B2 | * | 2/2013 | Kleman et al. | 392/308 |
| 8,450,666 | B2 | * | 5/2013 | Yang et al. | 219/628 |
| 2006/0213210 | A1 | * | 9/2006 | Tomlinson et al. | 62/238.6 |
| 2007/0298706 | A1 | * | 12/2007 | Hudon et al. | 454/256 |
| 2009/0126652 | A1 | * | 5/2009 | Murphy et al. | 122/19.2 |
| 2009/0142720 | A1 | * | 6/2009 | Pussell | 432/29 |
| 2009/0194040 | A1 | * | 8/2009 | Somajini | 122/19.2 |
| 2009/0260583 | A1 | * | 10/2009 | Choi | 122/19.2 |
| 2009/0308332 | A1 | * | 12/2009 | Tanbour | 122/14.2 |
| 2010/0018475 | A1 | * | 1/2010 | Arnold et al. | 122/18.1 |
| 2010/0101510 | A1 | * | 4/2010 | Tanbour et al. | 122/19.2 |
| 2012/0023990 | A1 | * | 2/2012 | Nelson et al. | 62/238.7 |
| 2012/0079995 | A1 | * | 4/2012 | Jacques et al. | 122/19.2 |
| 2013/0062343 | A1 | * | 3/2013 | Gerson et al. | 220/23.83 |

* cited by examiner

WATER SEEPAGE ABATEMENT IN WATER HEATERS

CROSS REFERENCE TO RELATED APPLICATION

The present application claims priority to the U.S. Provisional Application identified as Ser. No. 61/524,418, filed on Aug. 17, 2011, entitled "Condenser, Shroud, Foam Dam and Drip Plate for Water Heater," the disclosure of which is incorporated by reference herein.

BACKGROUND OF THE INVENTION

The subject matter disclosed herein relates to water heaters, and more particularly to techniques for preventing water seepage into a water heater.

Water heaters including heat pump water heaters (HPWHs) are typically covered with a shroud. The shroud covers a top portion of the water heater, which may include covering elements of a water heater such as an evaporator, a compressor, control circuitry, inlet and outlet pipes, etc. Shrouds may also include a filter.

The shroud serves several functions including, but not limited to, protection of elements of the water heater, structural support and ornamental functions. Shrouds are often expensive to manufacture and are not optimized for use on HPWHs.

Existing shrouds are known to allow water to seep into foam which surrounds the water tank. Such water may ultimately contact the tank, the condenser, the wrapper (around the foam and tank) and the bottom cover of the water heater. Such water seepage can cause corrosion and/or heat loss. Sources of water include, but are not limited to, inlet/outlet port connection leaks, external sources of water above the water heater such as a plumbing leak, an inlet/outlet extension pipe connection at the tank or other tank leak, and condensate from an evaporator which escapes a condensate collection tray. There is also a risk of wetting the foam surrounding the tank of the water heater during maintenance performed on the water heater.

BRIEF DESCRIPTION OF THE INVENTION

As described herein, the exemplary embodiments of the present invention overcome one or more disadvantages known in the art.

In one embodiment, a water heater system comprises a water heater, a cover, a shroud and at least one ring. The water heater comprises a tank, a layer of foam surrounding the tank and a wrapper surrounding the layer of foam. The cover is positioned on a top edge of the water heater. The shroud is positioned over the cover. The at least one ring is positioned around at least one of an inlet port and an outlet port of the water heater. The cover, shroud and at least one ring are operative to prevent a liquid from coming into contact with at least one of the layer of foam surrounding the tank and one or more components covered by the shroud.

In another embodiment, a shroud assembly for a water heater comprises a first part and a second part. The first and second parts join together along a seam such that the first and the second part form a hollow cylinder. The shroud assembly couples to a first portion of the water heater, and the seam is positioned near an axis of a center of an inlet port and an outlet port of the water heater. The first part of the shroud assembly comprises an opening for a controller of the water heater. At least one of the first part and the second part of the shroud assembly comprises an opening for the inlet port and the outlet port.

In yet another embodiment, a method comprises aligning a first part of a shroud with a corresponding first portion of a water heater, mating a first set of one or more slots or tabs formed on the first part of the shroud with a corresponding first set of slots or tabs formed in the first portion of the water heater, securing the first part of the shroud to a rigid structure of the water heater with a first set of one or more fasteners, aligning a second part of the shroud with the first part of the shroud and a second portion of the water heater, mating a second set of one or more slots or tabs formed on the second part of the shroud with a corresponding second set of slots or tabs formed on the first part of the shroud, securing a top edge of the second part of the shroud with a top edge of the first part of the shroud along a seam with a second set of one or more fasteners, and securing the second part of the shroud to the second portion of the water heater with a third set of one or more fasteners.

In yet another embodiment, a cover assembly for a water heater comprises one or more openings and one or more raised features surrounding at least one of the one or more openings. The one or more raised features are formed such that a liquid near the at least one opening is diverted away from the at least one opening.

In yet another embodiment a sealing ring surrounding a port comprises a base ring of with an inner edge forming a first opening, an interior sidewall sloping upwards from an outer edge of the base ring, an angled surface sloping downwards from a top edge of the interior sidewall, a base wall extending downwards from a bottom edge of the angled surface, a lip formed on the inner edge of the base ring forming a second opening, and a channel formed in a portion of the angled surface and the interior sidewall. The second opening is smaller than the first opening. The second opening is configured to mate with an outer surface of a connection to the port.

In yet another embodiment, a drip shield comprises a back plate and a base plate having a first end integrally formed with the back plate. The back plate couples to a first portion of a heating element port. The first portion of the heating element port projects out of a tank of a water heater. The base plate is positioned such that the base plate is below the first portion of the heating element port.

Advantageously, embodiments of the invention prevent water or other liquids from coming into contact with foam and corrosion-prone materials surrounding a water heater.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 1:
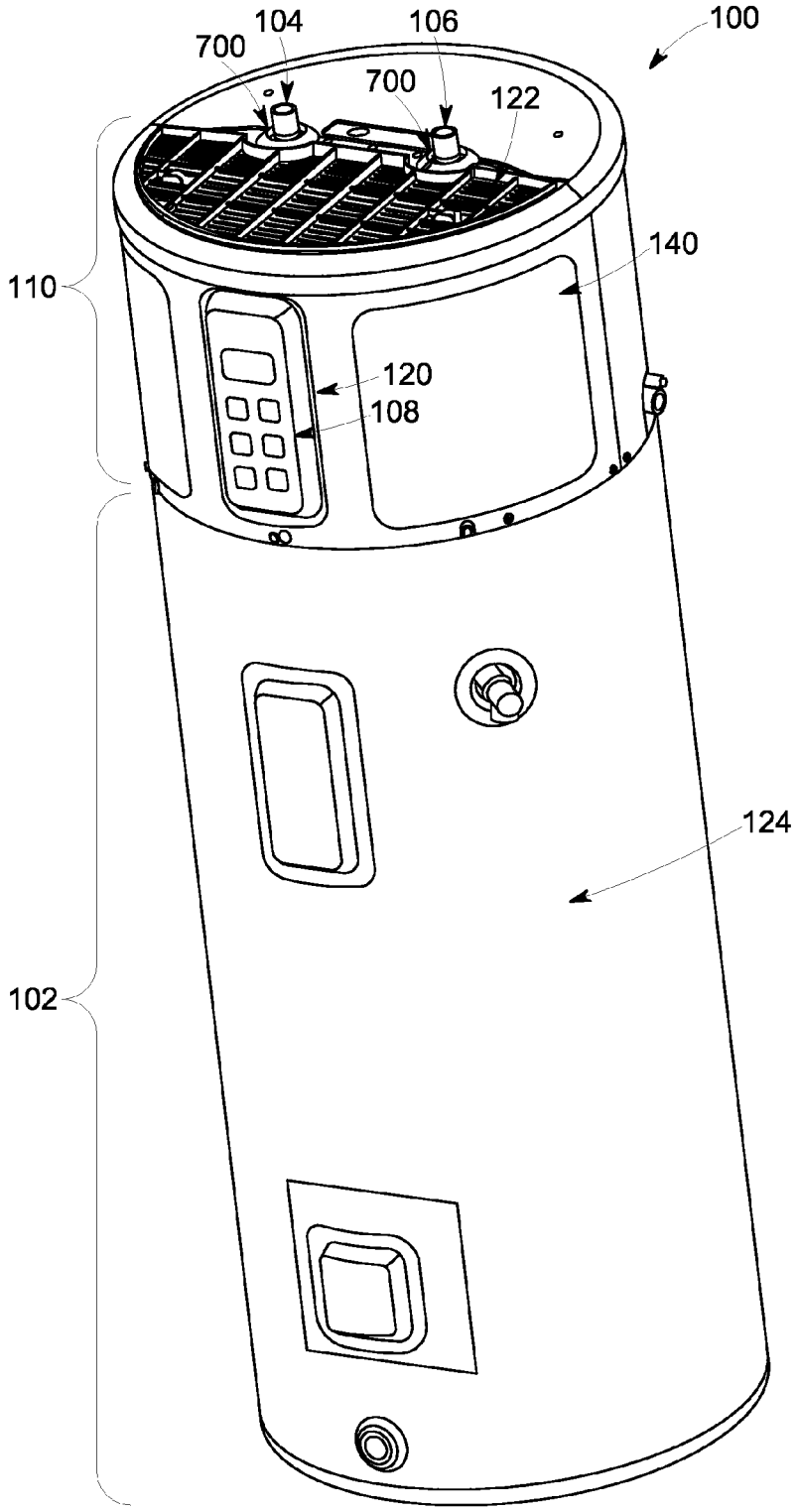
FIG. 1 is a perspective view of a HPWH having a tank that is capped by a shroud, according to an embodiment of the invention.

One or more of the embodiments of the invention will be described below in the context of an exemplary HPWH. However, it is to be understood that the embodiments of the invention are not intended to be limited solely to the HPWHs described herein. Rather, embodiments of the invention may be applied to and deployed in other suitable environments in which it would be desirable to reduce the manufacturing costs and/or improve the performance of water heaters.

As will be explained in detail herein, one or more illustrative embodiments of the invention provide a low cost metal shroud configured for use with a water heater. For example, one embodiment of the improved shroud includes the following: (a) top inlet/outlet ports; (b) front facing control; (c) airflow path—in through top, out through rear (allows room for front facing control) or in through front (either side of front-facing control), out through rear; and (d) a filter location for top-through-rear flow path, as well as for front-through-rear path. This filter location can be either located in a top of the shroud, directly in front of an evaporator, or in front of unit air inlets. Additionally, the improved shroud provides the following: (a) ease of assembly and service; (b) proper appearance (minimum and even gaps); and (c) satisfaction of structural requirements.

One or more illustrative embodiments of the invention also provide abatement from water (or any other liquid) seepage which, as mentioned above, could wet the foam that surrounds the water tank and/or could cause corrosion of the tank, the condenser and/or the bottom cover of the tank. For example, in one illustrative embodiment, a first set of plastic (polymeric or flexible rubber) rings seal on extension pipes/ports and act to prevent water from dripping down an extension pipe into the tank foam below. The rings are either sloped from an inner diameter to an outer diameter so as to shed water onto the top of the water heater shroud, or shaped to direct spilled water to a preferred location. In another illustrative embodiment, a second set of plastic (polymeric or flexible rubber) rings seal on a tank inlet/outlet port, and act to prevent water from following the extension pipe into the tank foam. Since very little, if any, water should make it past the first set of seal rings, this second set of seals should experience very little water.

Further, it is realized that any condensate water that escapes a condensate tray (not shown), or any water that spills/sprays above the water heater assembly, will fall to the top cover of the water heater. Thus, in yet another illustrative embodiment, the top cover is designed with raised surfaces around all openings, such that water that drips onto the top cover will not pass through holes into the foam. In one example implementation, water that puddles sufficiently to run off the top cover can be directed outside of the water heater, as a notification to a homeowner or maintenance personnel that a water leak needs attention.

Still further, an illustrative embodiment of the invention provides a drip shield. The drip shield is a part that can be positioned under a heating element port of a water heater to prevent water from dripping into the foam during regular maintenance of the heating element.

We now turn to a detailed description of one or more of the various embodiments mentioned above in the context of FIGS. 1-15.

Figure 2:
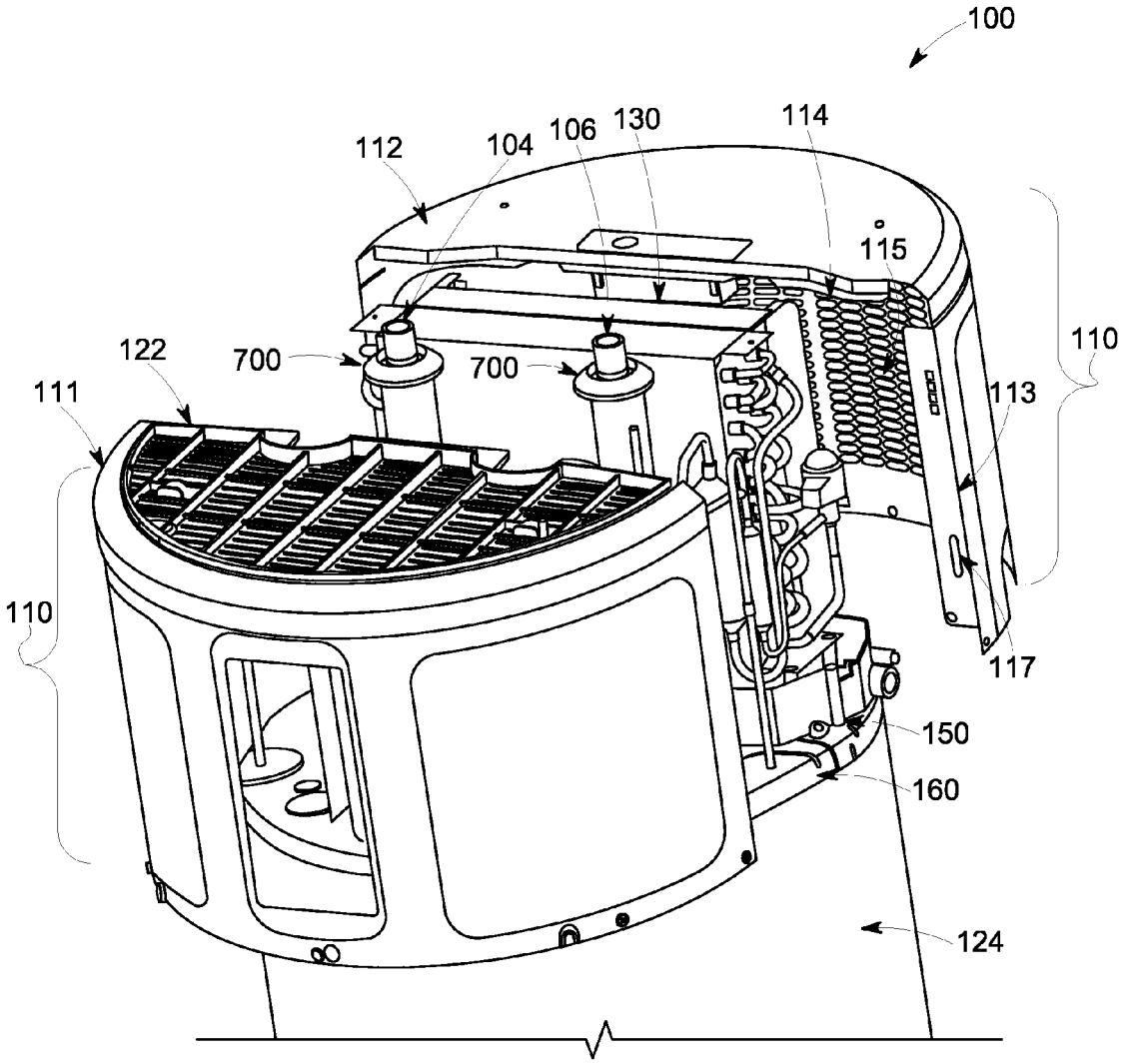
FIG. 2 is an exploded perspective view of the HPWH of FIG. 1 showing the shroud and elements of the HPWH underneath in more detail.
Figure 3:
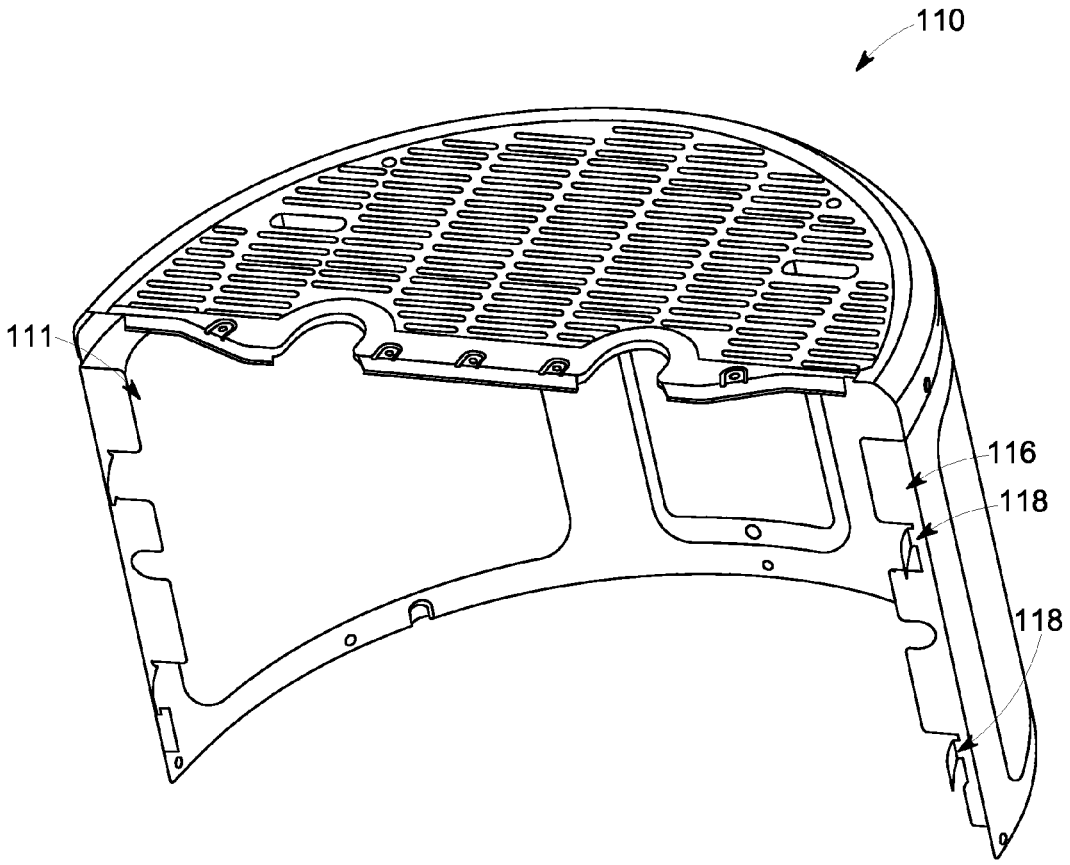
FIG. 3 is a perspective view of a first (or front) half of the shroud of FIG. 1.
Figure 4:
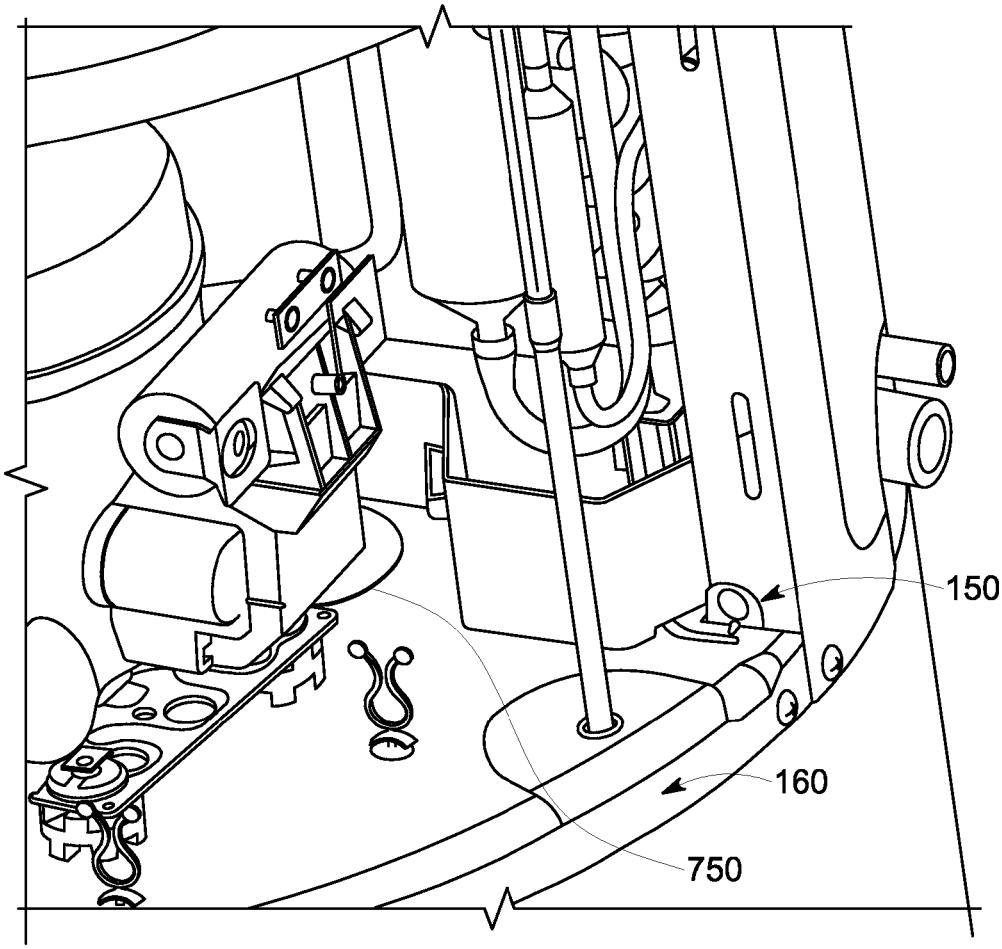
FIG. 4 is perspective view of a top portion of the water heater of FIG. 1.

FIG. 1 is a perspective view of an embodiment of a water heater 100 having a tank 102 that is capped by a shroud 110. The water heater 100 may be a HPWH. FIG. 2 is an exploded perspective view of the water heater 100 showing the shroud 110 and elements of the water heater 100 underneath it in more detail. FIG. 3 is a perspective view of a first (or front) part 111 of the shroud 110. FIG. 4 is another perspective view of the water heater 100 of FIG. 2.

Shroud 110 provides several specific functions including an electrical enclosure or cabinet function to prevent access of electrical wiring or terminations, supports user interface controls, airflow channeling (i.e., providing inlet and outlet air openings), structural support such that the HPWH can withstand normal forces encountered during handling, installation and use, and appearance/decorative functions. Shroud 110 is designed to allow for easy assembly and removal, both for manufacturing and service of the HPWH.

Shroud 110 is a metal shroud with top inlet and outlet ports, placed in a location similar to those of existing water heaters. The metal shroud advantageously provides a front facing control as well as optimal airflow path and filter location. The airflow path may be in through the top, out through the rear to allow room for the front facing control, or may be in through the front on either or both sides of the front facing control and out through the rear. The filter location for the top-through-rear and front-through-rear airflow paths can be located in the top of the unit, directly in front of the evaporator, or in front of unit air inlets.

As shown in FIGS. 1 and 2, an embodiment of the shroud 110 has a first part 111 and a corresponding second (or rear) part 112, which join together along seam 140 using one or more tabs and/or fasteners. The seam 140 may continue from the sides and across the top of the shroud 110, and may follow proximate the inlet/outlet ports so that one or both subassemblies (or parts) 111, 112 of the shroud 110 can be fully removed after installation, without disconnecting any plumbing. In some embodiments, the seam 140 is positioned near the line connecting the outlet port 104 and inlet port 106 of the water heater 100. The one or more fasteners may fit through one or more holes formed along the central edges and/or tabs of the first part 111 and the second part 112. In one embodiment, the fasteners are screws. In another embodiment, the fasteners may be spring clips or a combination of screws and spring clips. When the two parts (or subassemblies) 111 and 112 are joined together, they form a hollow cylinder having one end open. This end couples with the wrapper 124 and/or the insulating foam of the water heater. The first part 111 has an opening 120 formed therein and is configured to allow access to a controller 108, which presents a user interface, comprised of one or more input devices (such as buttons), computer readable instructions stored in a memory device and executed by the controller (which may comprise one or more physical and/or virtual processors), and/or an output device (such as a display device and/or indicators).

The shroud 110 further includes an opening (or openings) through which the hot water outlet 104 and the cold water inlet 106 fit. A filter 122 may be disposed at any suitable location of the shroud 110. In one embodiment, the filter 122 is positioned on a top surface of the first part 111 of the shroud 110, and has a generally hemispherical shape. The filter 122 may be removable from the shroud 110. FIG. 1 also shows the first set of seals 700 fitted around the extension ports of hot water outlet 104 and cold water inlet 106.

As shown in FIG. 2, a portion of the shroud 110 may have a vent 115 formed therein. In one embodiment, the vent 115 is formed in the second part 112. The second part 112 has one or more tabs 114 along its central top edge, and/or one or more tabs 113 disposed along its central side edges. The tabs 113 have one or more slots 117 formed therein. These slots 117 are configured to engage one or more corresponding tapered tabs 118 that project from the first part 111. Insertion of the tapered tabs 118 (FIG. 3) into the slots 117, draws the two parts 111 and 112 together. An evaporator assembly 130 (and/or the controller 108 (FIG. 1)) may be housed within the shroud 110.

As shown in FIG. 3, the first part 111 of the shroud 110 may have one or more tabs 116 formed along its central side edges providing columnar strength. The tabs 113 of the second part 112 and the tabs 116 of the first part 111 are configured to mate with each other to provide vertical structural support to the shroud 110.

As further shown in FIGS. 1, 2 and 3, the shroud 110 has an airflow path that flows in the top of the shroud 110 through the filter 122 and out through the venting 115 at the rear. This permits placement of the controller 108 at the front of the water heater 100. Alternatively, the shroud 110 may have an airflow path that flows in the front of the shroud 110 on either side of the controller 108 and out through the venting 115 in the second (rear) part 112.

The first part 111 of the shroud 110 is preferably not tethered by the controller 108 (meaning the first part 111 of the shroud can be removed without being tied to the controller 108, or the controller 108 can be easily detached from the first part 111). In an embodiment, the controller 108 can be serviced without removing the shroud 110. In an embodiment, the second part 112 of the shroud 110 can be assembled or removed by a person (or robot) positioned in front of the water heater. This is made possible by at least one or more features. First, there are no rear-facing screws connecting the second part 112 to the water heater 100. Second, the tab 113 of the second part 112 can be secured to the top cover 160 by one or more tabs 150. As illustratively shown in FIGS. 2 and 4, the tab(s) 150 may be integrally formed with the top cover 160. Alternatively, the tab(s) 150 can be L-shaped, with a portion that slides within a slot formed in the top cover 160. In any case, a portion of the tab(s) 150 can be positioned substantially parallel with the side tab 113 of the second part 113. A fastener, such as a screw or snap-fit member, etc., can be used to couple the tab(s) 150 to the side tab(s) 117. Third, the top of the second part 112 can be removably coupled with the evaporator assembly or other structural members within the water heater assembly such as the outlet/inlet extension pipes 104/106. In one embodiment, as shown in FIGS. 2 and 4, one or more front-facing screws to pull the rear second part 112 tight against the top cover 160, and one or more screws passing through the side of the shroud 110 and into a portion of the water heater wrapper 124 provide final alignment and strength. FIG. 4 also shows one of the second set of sealing rings 750 around one of inlet/outlet ports on the top cover. The second set of sealing rings 750 prevent any water which passes through the first set of rings as well as any water which originates from a source below the first set of rings from wetting the tank foam.

Gaps between the two parts 111 and 112 can be minimized using the vertical side joints (e.g., tabs 115 and 116), which are made to be face joints (e.g., about a 90 degree bend on the vertical contact edge). As mentioned above, the tapered tab(s) 118 close the gap between the first part 111 and the second part 112. An appearance ring (not shown) may be used to cover all joints around the perimeter at the top of the shroud 110.

One or more structural features of the shroud can carry compressive load through the shroud into the tank/foam assembly. Vertical side-seams with 90-degree bend on a leading edge to give vertical column strength carry vertical load from the top of shroud into the water heater top cover 160 and/or tank/foam assembly. The first part 111 and the second part 112 are configured to carry load from their top portions into evaporator brackets or inlet/outlet extension pipes to the water heater top cover 160 (also called "mid-top cover"). A Z-bend feature along inlet/outlet seam is built into the first part 111 and second part 112 for added support. Columnar design of outlet vents brings vertical load bearing. Shorter vents allows for more columns. Rear tabs 150 that engage rear shroud 112 to the top cover 160, and all screws in the front 180 degrees of the first part 111 and second part 112 carry vertical loads into the top cover 160 and tank/foam assembly. In addition, an I-beam feature may be built into the first part 111 and second part 112 along a seam connecting the inlet and outlet ports for added support.

Figure 5:
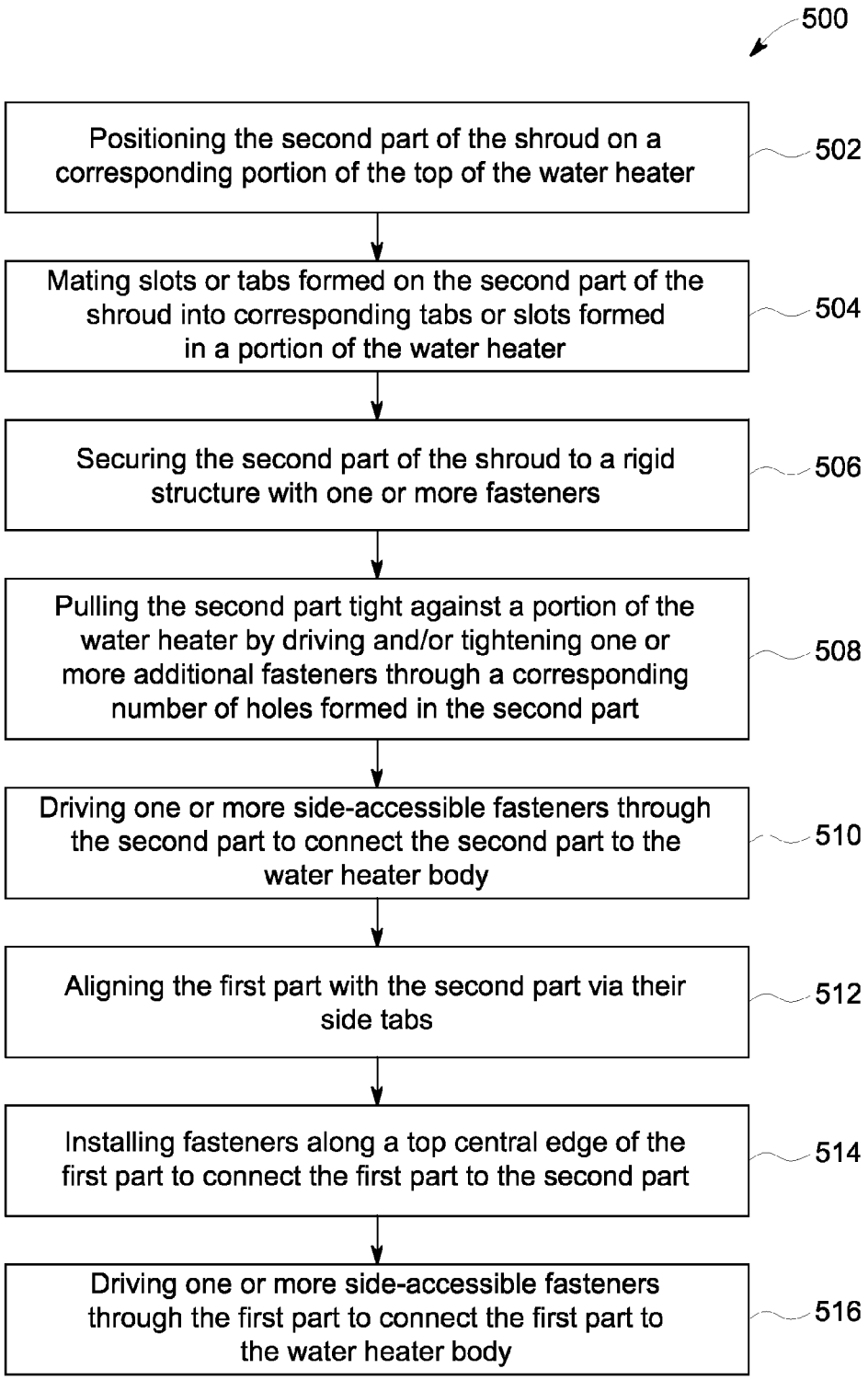
FIG. 5 is a flowchart illustrating a method of assembling a shroud of a water heater, according to an embodiment of the invention.

FIG. 5 is a flowchart illustrating a method 500 of assembling the shroud 110 of FIGS. 1-4. Referring to FIGS. 1-5, the method 500 includes positioning 502 the second part 112 of the shroud 110 on a corresponding portion of the top of the water heater 100. The method 500 further includes mating 504 slots 117 or tabs 113 formed on the second part 112 of the shroud 110 into corresponding tabs or slots 150 formed on or in a portion of the water heater 100. The method 500 also includes securing 506 the second part 112 of the shroud 110 to a rigid structure (e.g., the evaporator of the water heater 100 and/or to one of the cold water or hot water pipes) with one or more fasteners. Further, the method 500 includes pulling 508 the second part 112 tight against a portion of the water heater 100 (e.g., making the second part 112 concentric with the water heater body) by driving and/or tightening one or more additional fasteners through a corresponding number of holes formed in the second part 112, which one or more additional fasteners may engage corresponding structures of the water heater 100, such as one or more tabs 150 formed about mid-top cover. The method 500 further includes driving 510 one or more side-accessible fasteners through the second part 112 to connect the second part 112 to the water heater tank/foam assembly or body.

The method 500 also includes aligning 512 the first part 111 with the second part 112 via the tabs 118. As mentioned above, the tabs 118 may have a tapered configuration that draws the first part 111 and the second part 112 together. The method 500 further includes installing 514 fasteners along a top central edge of the first part to connect the first part 111 to the second part 112. Lastly, the method 500 includes driving 516 one or more side-accessible fasteners through the first part 111 to connect the first part 111 to the water heater body.

Figure 6:
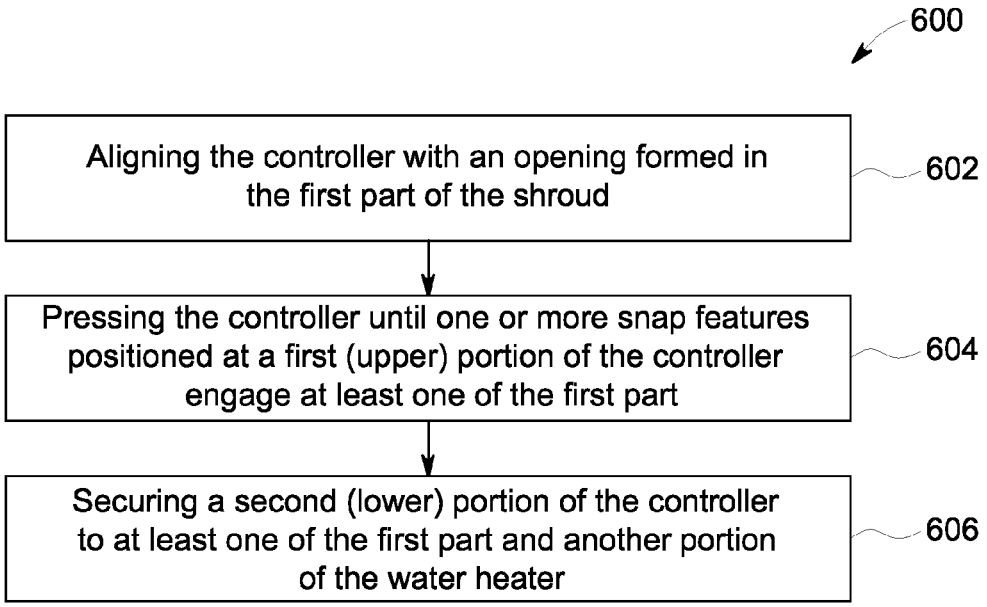
FIG. 6 is a flowchart of a method of installing a controller of a water heater, according to an embodiment of the invention.

FIG. 6 is a flowchart of a method 600 of installing the controller 108 of FIGS. 1 and 2. Referring to FIGS. 1, 2 and 6, the method 600 begins by aligning 602 the controller 108 with an opening 120 formed in the first part 111 of the shroud 110. The method 600 further includes pressing 604 the controller 108 until one or more snap features (or tab/slots) positioned at a first (upper) portion of the controller 108 engage at least one of the first part 111 and a portion of the water heater 100. Further, the method 600 includes securing 606 a second (lower) portion of the controller 108 to at least one of the first part 111 and another portion of the water heater 100. In one embodiment, the length(s) of wire that are coupled with the controller 108 allow the controller 108 to be unfastened and rotated as a hinge-like door, to gain access to the rear side of the controller 108 for service, and/or fully detached from the first part 111. Of course, the controller 108 can be positioned and secured using tabs/slots, snap features, fasteners, etc., that are located at or on other areas of the controller.

The shroud 110 above has been described as having two parts 111 and 112 that are coupled together using tabs 118, slots 117 and fasteners, but other embodiments are possible and contemplated. For example, a hinge may connect the first part 111 and the second part 112 along one side. In such an embodiment, the first part 111 and the second part 112 are opened and placed on the top cover 160. The first part 111 and the second part 112 are then brought together and pulled concentric to the top cover 160 and/or the wrapper 124 using a latch, which can be unfastened.

As mentioned above, it is realized that in existing water heaters, water may pass through a shroud covering a water heater and through the top cover of the water heater and into the foam surrounding the tank of the water heater. Water may ultimately come into contact with the tank, the condenser, the wrapper and the bottom cover of the water heater. Water passing into the foam can lead to corrosion of the condenser, the tank, the wrapper and the bottom cover. It also may lead to increased heat loss due to wet foam. There are various sources of water which may pass through the top cover of the water heater, including inlet/outlet port connection leaks due to an installation or manufacturing defect, an external source above the water heater, a manufacturing defect of the inlet/outlet extension pipe connection at the tank, and condensate from the evaporator which escapes the condensate collection tray. Embodiments of the invention provide techniques for overcoming these issues. For example, illustrative embodiments use sealing rings and/or an improved top cover.

Water seepage abatement techniques as described herein can also be applied to external condensers surrounding a tank of a water heater, such as the steel condensers disclosed in the U.S. patent application Ser. No. 13/571,726, entitled "Condenser for Water Heater," which is filed concurrently herewith and incorporated by reference herein. Since steel is susceptible to humidity and moisture conditions in water heater environments, a foam layer is used to provide a barrier to such moisture and humidity. In illustrative embodiments, a layer of foam ranging between about a ½ inch and about 2 inches in thickness provides a sufficient barrier. This layer of foam may be in addition to existing foam which surrounds the tank and external condenser, and may be placed in positions on the tank where the risk of exposure to moisture and humidity is greatest. Such positions can include ports of the water heater, such as the heating element ports discussed below.

Figure 7:
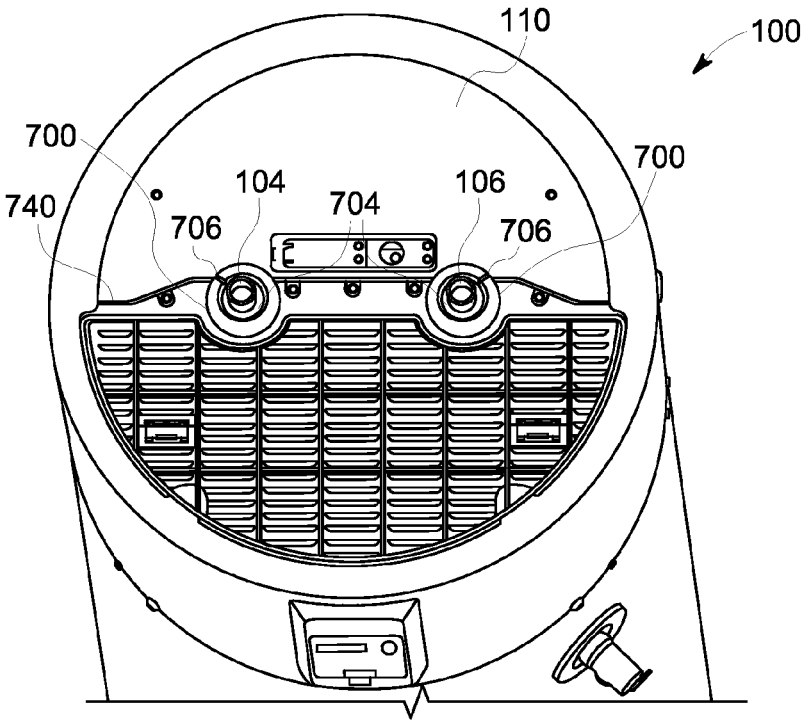
FIG. 7 is a perspective view of a top of a water heater shroud showing a sealing ring, according to an embodiment of the invention.
Figure 8:
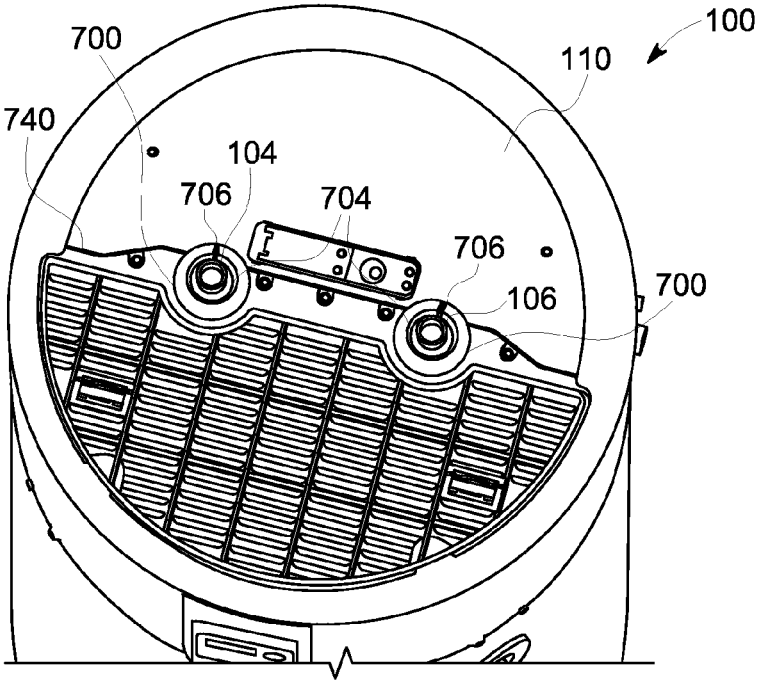
FIG. 8 is a perspective view of a top of a water heater shroud showing a sealing ring, according to another embodiment of the invention.
Figure 9:
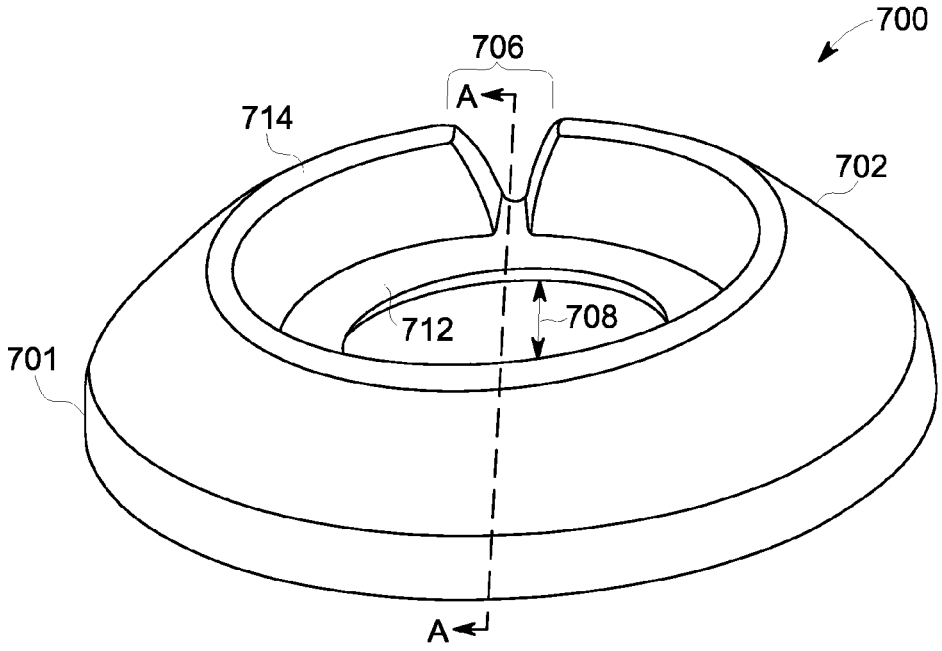
FIG. 9 is a perspective view of the sealing ring of FIGS. 7 and 8.
Figure 10:
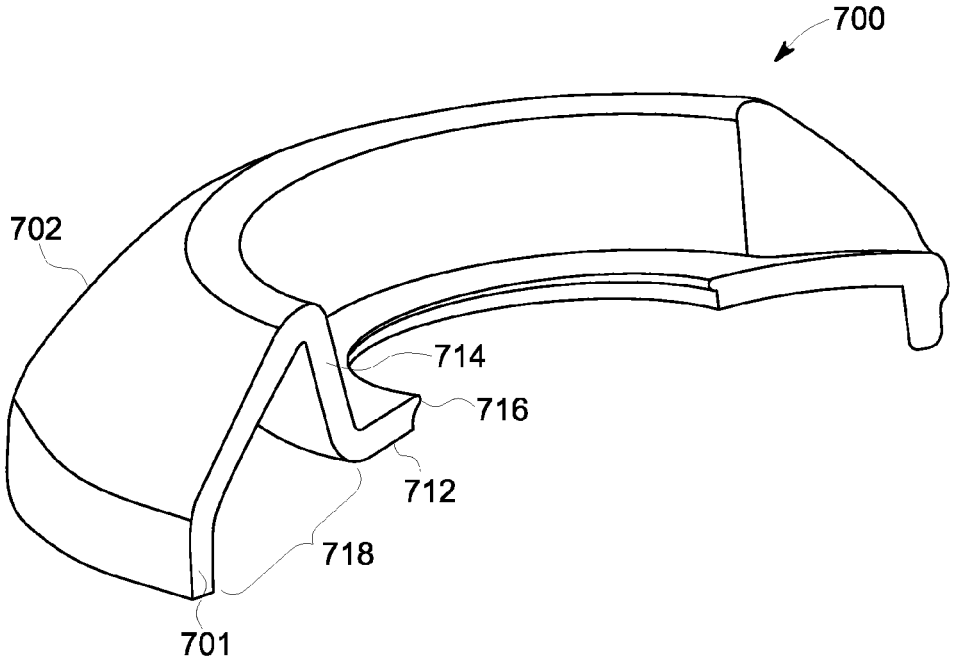
FIG. 10 is a cross-sectional view of the sealing ring of FIG. 9, taken along line A-A.

FIG. 7 is a perspective view of a top of a water heater shroud 110 showing a pair of sealing rings 700 in a first arrangement. FIG. 8 is a perspective view of a top of a water heater shroud 110 showing sealing rings 700 in a second arrangement. FIG. 9 is a perspective view of one of the sealing rings 700 of FIGS. 7 and 8. FIG. 10 is a cross-sectional view of one of the sealing rings 700 of FIGS. 7-9, taken along line A-A. Referring to FIGS. 7-9, the sealing ring 700 fits around a hot water outlet 104 and around a cold water inlet 106 that protrudes through the shroud 110. Each sealing ring 700 includes an annular outer base wall 701, which has an angled surface 702. The annular angled surface 702 slopes upward from the base wall 701 and then folds over to form the annular interior sidewall 714. The sidewall 714 then folds orthogonally to form the annular base ring 712. The ring 712 has a first opening 708 formed therein. A lip 716 is formed around the circumference of the first opening 708 and is configured to mate with an outer surface of a pipe or tube, such as the hot water pipe 104 or the cold water pipe 106. The circumference of the sidewall 714 forms a larger second opening 710 therein. The base wall 701 and the sidewall 714 can be separated by a space 718. The annular sidewall 714 and angled surface 702 have a channel 706 formed there through.

In use, water falls onto the sealing ring 700 and is either diverted away by the angled surface 702 or falls within moat 704. Water falling in the moat 704 is prevented from slipping down the hot water outlet 104 or the cold water inlet 106 by the base ring 712 and the lip 716 of the first opening 708. Additionally, water captured by the moat 704 is diverted through the channel 706 to exit the sealing ring 700. Water diverted by the sealing ring 700 exits to any point on top of the shroud 110, ultimately finding its way through and dripping on the top cover 160. However, the configuration of the sealing ring 700 ensures that the water does not make it back to the hot water outlet 104 or the cold water inlet 106. In the arrangement of FIG. 7, the channel 706 is positioned to direct water towards a path 740. In the arrangement of FIG. 8, the channel 706 is positioned to direct water onto the shroud 110. The shroud 110 may be sloped such that the water directed through channel 706 flows towards the edges of the shroud 710.

Figure 11:
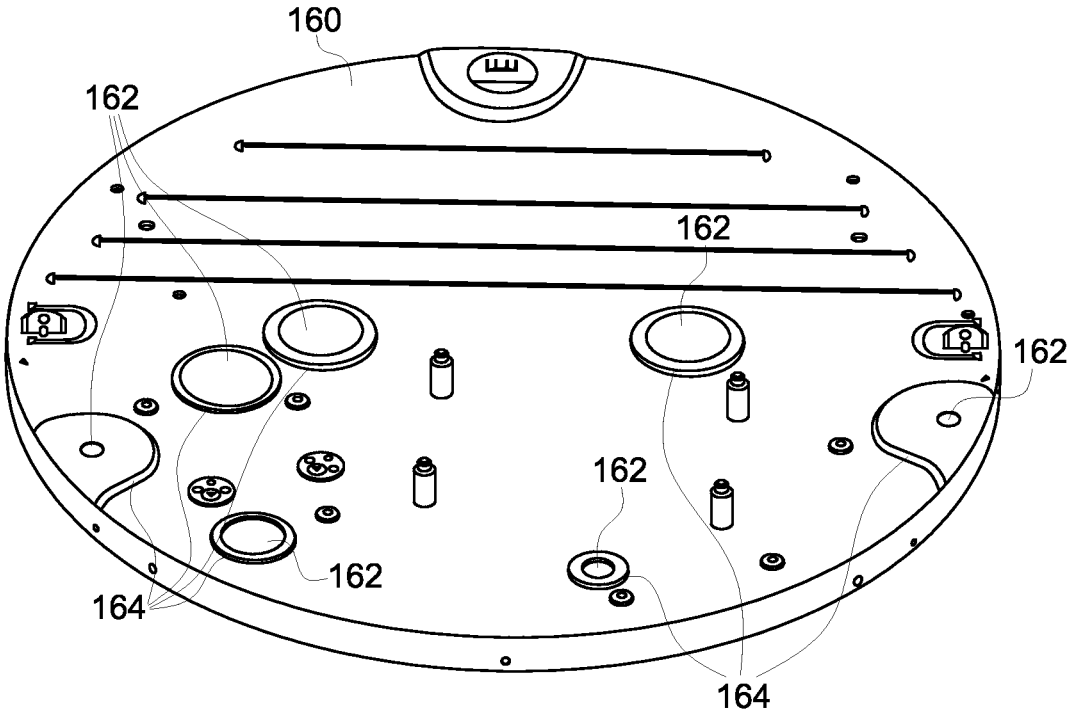
FIG. 11 is a top perspective view of a water heater top cover having one or more raised surfaces around one or more openings formed in the top cover, according to an embodiment of the invention.

FIG. 11 is a top perspective view of an embodiment of a water heater top cover 160 having one or more raised surfaces 164 around one or more holes (openings) 162 formed in the top cover 160. The raised surfaces 164 ensure that water that slips under the sealing ring 700, if any, does not flow through the holes 162. Accordingly, use of the sealing rings 700 and/or the top cover 160 can keep the foam of the water heater dry, thereby preventing heating efficiency from being reduced and preventing corrosion. The sealing rings 700 and the raised surfaces 164 ensure that water which puddles sufficiently to run off the top cover 160 will be directed outside of the water heater. As such, it will be readily apparent to the user of the water heater that there is a leak, and proper corrective action may be taken.

During maintenance of a heating element of a water heater, it is realized that water may drip into the foam surrounding the heating element port. In addition, a leaking heating element port may drip water into the foam surrounding the heating element port during normal operation of a water heater. Illustrative embodiments of the invention provide drip shields to prevent a heating element port from leaking or dripping water into the foam of the water heater, which as discussed above can lead to various problems.

Figure 13:
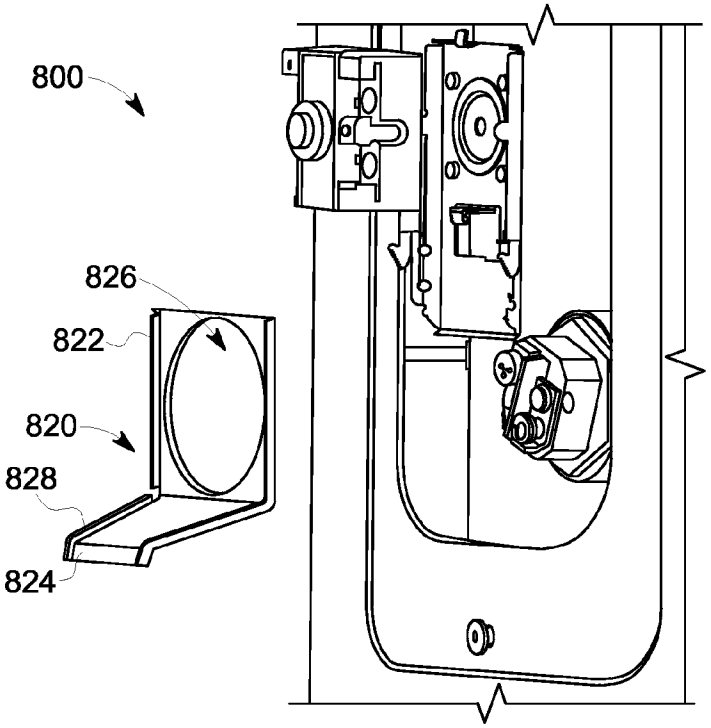
FIG. 13 is an exploded perspective view of the drip shield of FIG. 12.
Figure 12:
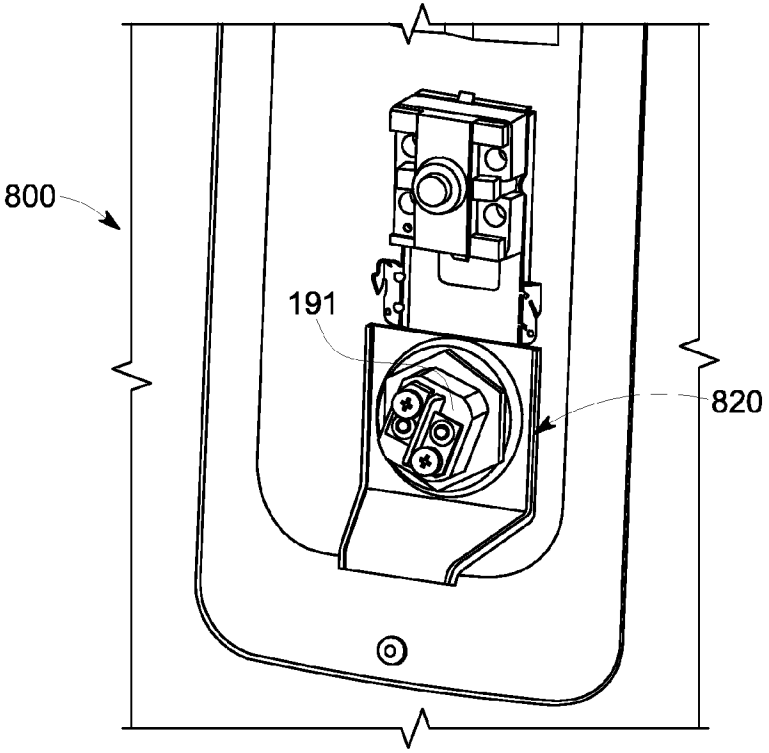
FIG. 12 is a perspective view of a drip shield, according to an embodiment of the invention.
Figure 15:
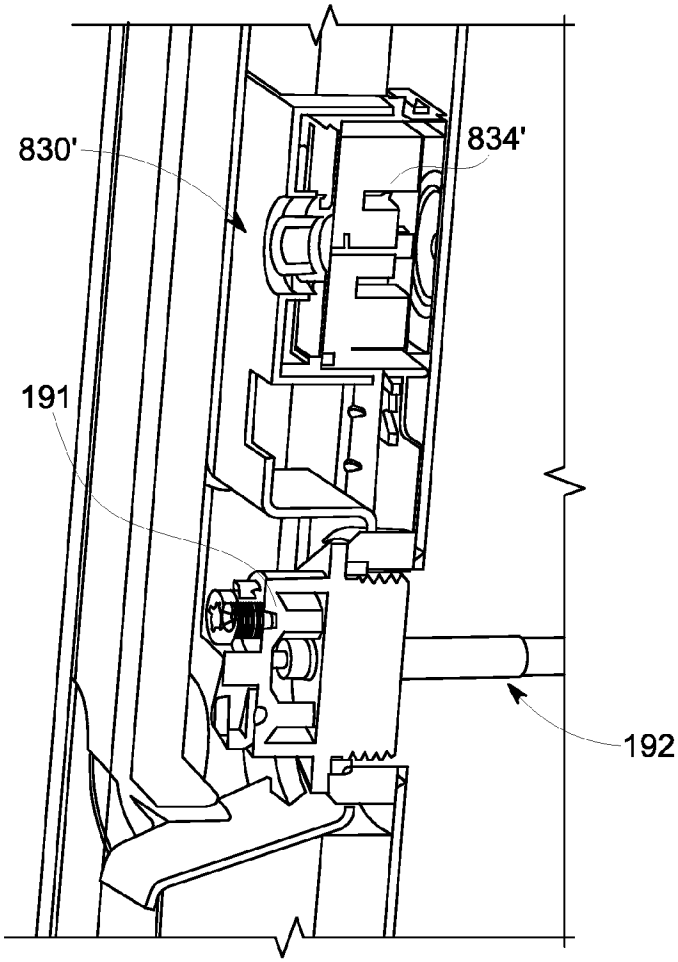
FIG. 15 is a cross-sectional side view, taken along line B-B, of the drip shield of FIG. 14 installed on a water heater.
Figure 14:
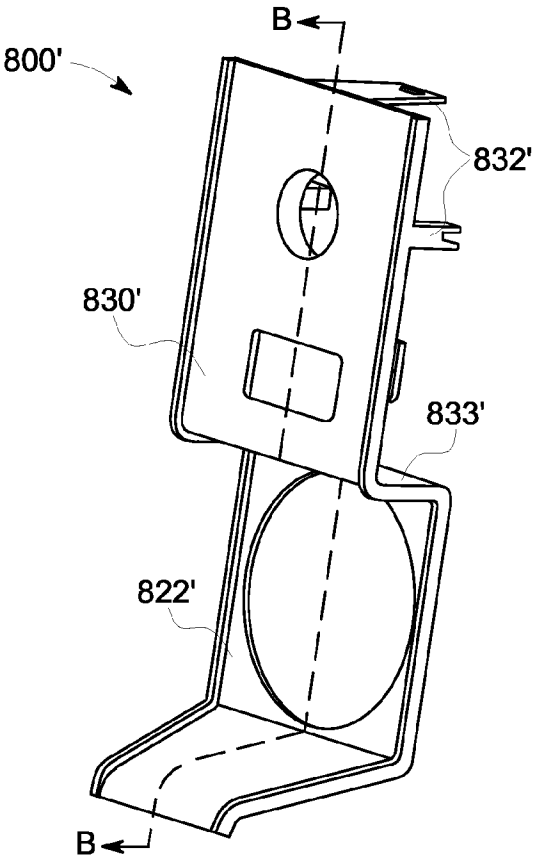
FIG. 14 is a perspective front view of a drip shield, according to another embodiment of the invention.

FIG. 12 is a perspective view of a drip shield 800 installed on a portion of a heating element port 191 that protrudes from a water heater. FIG. 13 is an exploded perspective view of the drip shield 800 of FIG. 12. FIG. 14 is a perspective front view of another embodiment of a drip shield 800'. FIG. 15 is a cross-sectional side view, taken along line B-B, of the drip shield 800' of FIG. 14 installed on a water heater.

The drip shield 800 includes a first member 820. The first member 820 has a backplate 822. The backplate 822 has an opening 826 formed therein. The opening 826 is sized to fit around a portion of a heating element port 191 that projects from the tank of the water heater. The heating element port 191 may surround an upper heating element 192 of the water heater as shown in FIG. 15. The first member 820 also has a base plate 828. One end of the base plate 828 is integrally attached to the back plate 822. The other end of the base plate 828 curves downwards to form a lip 824. When the drip plate 800 is installed on a water heater, at least the drip plate 800 may project through an opening formed in the metal wrapper of the water heater. In one embodiment, the drip plate 800 is formed of plastic. The drip plate 800 may be friction-fit around the portion of the heating element port 191. Additionally, or alternatively, the drip plate 800 may be held in place by a cap (not shown) that couples with a portion of the heating element port 191.

Another embodiment of a drip shield 800' is shown in FIGS. 14 and 15. In this embodiment, the drip shield 800' may be formed of plastic and/or dielectric material. The back plate 822' may be integrally formed with a riser 833'. The riser 833' may be integrally formed with an upper plate 830'. The upper plate 830' may have one or more openings formed therein, and one or more tabs 832' attached thereto. These tabs 832' may couple with corresponding slots on the thermal cut-off unit 834', and/or may couple with a bracket attached to the water tank.

Other techniques and apparatus may be used in conjunction with drip shields to prevent water seepage around a heating element port 191, including a foam dam as described in the U.S. patent application Ser. No. 13/571,789, entitled "Foam Dam for Appliance," which is filed concurrently herewith and incorporated by reference herein.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the scope of the following claims.

What is claimed is:

1. A shroud assembly for a water heater comprising:

a first part; and a second part, the first part and the second part joining together along a seam such that the first part and the second part form a hollow cylinder, wherein the shroud assembly couples to a first portion of the water heater, the seam being positioned near an axis of a center of an inlet port and an outlet port of the water heater; the first part of the shroud assembly comprises an opening for a controller of the water heater; and at least one of the first part and the second part of the shroud assembly comprises an opening for the inlet port and the outlet port; and wherein the controller and the first part of the shroud assembly are removable independent of one another.

2. The shroud assembly of claim 1, wherein the first portion of the water heater is a top portion of the water heater and wherein the shroud assembly covers at least one of the controller of the water heater, an evaporator of the water heater, and a cover of the water heater.

3. The shroud assembly of claim 1, wherein the shroud assembly is configured to allow the inlet port and the outlet port to extend from a top of the water heater.

4. The shroud assembly of claim 1, wherein:

the first part aligns with a front view of the water heater and the second part aligns with a rear view of the water heater;

the first part and the second part are joined on the seam through a first set of one or more tabs and fasteners and the second part is configured for attachment to the water heater through a second set of one or more tabs and fasteners; and wherein the first set and the second set of one or more tabs and fasteners are positioned such that the first set and the second set of one or more tabs and fasteners are accessible by a user from one of the front view and the rear view.

5. The shroud assembly of claim 1, wherein the first part of the shroud assembly is removable independent of the second part of the shroud assembly.

6. The shroud assembly of claim 1, wherein the opening for the controller of the water heater is positioned such that the controller is accessible from a front view of the water heater.

7. The shroud assembly of claim 1, wherein the first part of the shroud assembly comprises at least one front vent on at least one side of the controller opening and the second part of the shroud assembly comprises at least one rear vent positioned on a rear portion of the second part of the shroud assembly to allow a front-through-rear airflow path through the shroud assembly.

8. The shroud assembly of claim 1, wherein the first part of the shroud assembly comprises at least one top vent positioned on a top portion of the first part and the second part of the shroud assembly comprises at least one rear vent positioned on a rear portion of the second part to allow a top-through-rear airflow path through the shroud assembly.

9. The shroud assembly of claim 1, wherein at least one of the first part and the second part comprises at least one structural support to carry a load from the shroud assembly into the water heater.

10. The shroud assembly of claim 3, wherein the first set and the second set of one or more tabs and fasteners are positioned such that the first set and the second set of one or more tabs and fasteners are accessible by the user from the front view.

11. The shroud assembly of claim 1, wherein the first part of the shroud assembly is removable without disconnecting any plumbing from the water heater.

* * * * *